United States Patent [19]

Maione

[11] 3,955,563

[45] May 11, 1976

[54] PNEUMATIC PERCUSSOR

[76] Inventor: Albert Maione, 5 Vincent St., Parlin, N.J. 08859

[22] Filed: Jan. 6, 1975

[21] Appl. No.: 538,770

[52] U.S. Cl. ..... 128/53; 128/55

[51] Int. Cl.[2] ..... A61H 7/00; A61H 23/00

[58] Field of Search ..... 128/50–55, 128/DIG. 10

[56] References Cited

UNITED STATES PATENTS

| | | | |
|---|---|---|---|
| 1,796,444 | 3/1931 | Dellera et al. | 128/55 |
| 3,209,748 | 10/1965 | Thomas | 128/53 |
| 3,351,052 | 11/1967 | Hewson | 128/53 |

FOREIGN PATENTS OR APPLICATIONS

| | | | |
|---|---|---|---|
| 1,563,994 | 3/1969 | France | 128/53 |
| 1,535,612 | 7/1968 | France | 128/53 |

*Primary Examiner*—Lawrence W. Trapp
*Attorney, Agent, or Firm*—Charles I. Brodsky

[57] ABSTRACT

A percussor, especially useful in the therapeutic treatment of cystic fibrosis and other lung disorders, employs pneumatic power to provide a given reciprocating motion. Such motion can, in turn, be regulated either by electronic pulse, or fluidic air, control.

9 Claims, 3 Drawing Figures

PNEUMATIC PERCUSSOR

FIELD OF THE INVENTION

This invention relates to therapeutic percussors and, more particularly, to a pneumatic percussor advantageous for use in the treatment of cystic fibrosis and other lung disorders.

BACKGROUND OF THE INVENTION

As is well known and understood, percussors are but one of the therapeutic devices used to treat cystic fibrosis and other lung disorders. In general, these devices are used to clear lung passages, so that breathing may become easier and so that the possibility of bacterial infection often associated with lung cloggage may be reduced. In addition to the use of percussors, inhalation therapy for lung disorders has also employed air compressors and nebulizers, frequently to atomize medication to a mist, to be applied via mask attachments in an attempt to unclog air passages and kill-off bacteria which amass there. A second therapy employs an inhalation tent and untrasonic mist to surround a body within a fog, on the theory that if the body is kept wet outside, the lobes of the lungs will be kept wet inside, and mucus clogging will be reduced.

In the therapeutic treatment of cystic fibrosis utilizing presently known percussors, a child (for cystic fibrosis is generally a genetic disease which affects children) is held in an inclined position and the reciprocating action of the moving element of the percussor is used to mechanically "clap" around the lung areas in an attempt to break up the mucus blockage. The treatment is continued, with the percussor operating at one location, until the child starts to cough, an indication that the lung passage is beginning to clear. The percussor is then moved to a second location, and the mechanical clapping treatment begun anew in a further attempt to work the mucus free of the lung passages. Besides re-positioning the percussor, the child is also re-oriented, in an attempt to take advantage of gravity in causing the mucus to break and flow.

There are, however, many disadvantages to the use of these percussors. First of all, as cystic fibrosis is a disease which children are born with, and as these children are generally unable to be kept still during the treatment, one hand almost always is placed on the child's body to insure the correct positioning of the percussor while the other hand is used to support and guide the percussor. As these known percussors resemble mechanical sabre saws having a suction cup at its blade end to provide the reciprocating "clapping" motion, as they weigh in order of 10–15 pounds each, as their reciprocating motions exert a force on the hand and arm using it, and as the treatment could last for hours on end during some critical periods of illness, it will be seen that their usage, although necessary to the treatment, becomes quite strenuous and tiring. Secondly, the reciprocating mechanical linkage provides an unyeilding pressure force, such that, to prevent against damage to kidneys, vertebrae, ribs, etc. during treatment, the placement of the percussor is critical. This is all the more important as the suction cup employed covers a relatively large portion of the child's body, and the mechanical percussor's weight and translated force can cause injury even while treating. Furthermore, the high piercing frequencies and the high noise levels of these mechanical percussors have been found to be particularly annoying, if not frightening, to the child. At times, their exhaust motors have been noted to exhibit a tendency to draw the child's hair into the machine, pulling the child after it. Also, mechanical percussors cannot be used in the oxygen rich environment of a hospital room, because of the possible sparking of the electrically powered machine in these combustible atmospheres.

Nevertheless, mechanical percussors continue to find wide acceptance because of their ability to bring up mucus and unclog the lung passages more effectively than manual, hand clapping — and, although the treatment still may take hours, it continues to be a much faster treatment than manual attempts to break up the mucus cloggage. In an attempt to hasten the clearing of the lung passage even more, the ultrasonic mist tent or the air compressor-nebulizer arrangement previously referred to are oftentimes used as treatment prior to any use of these mechanical percussors.

SUMMARY OF THE INVENTION

As will become clear hereinafter, the present invention employs pneumatic control of the reciprocating mechanism, instead of a mechanical or electromechanical control, and permits a substantial reduction in percussor size and mass to facilitate its accurate placement and ease its operation. Although an air supply is necessary for it to operate, it will be seen that that same air compressor as is used in atomizing the mist in the nebulizer inhalation equipment can be used to operate, in this case, an air cylinder driving a spring return plunger, onto the end of which a suction device is affixed. Simply by increasing or decreasing the bore size of the air cylinder — or by increasing or decreasing the supply of the pressurized air — the blow-force of the pneumatic percussor can be easily regulated.

Two embodiments of the invention are described. In one, electronic pulses are employed to control the reciprocation rate, while in the other, fluidic air pulses are the means of providing the control. In the electronic version, a valve is actuated by a train of oscillator pulses to permit the intake of air to gate and push forward the spring return plunger. The frequency of oscillation will thus be seen to determine the rate at which the air bursts reciprocate the suction device. In the fluidic version, a valve is actuated by pulses of air bled from the main supply to gate the larger bursts needed to activate the plunger mechanism. As will be seen, this second version is particularly attractive for use in the oxygen rich environment of the hospital becuase of its explosion-proof nature.

BRIEF DESCRIPTION OF THE DRAWING

These and other features of the present invention will be more clearly understood from a consideration of the following description taken in connection with the accompanying drawing in which.

DETAILED DESCRIPTION OF THE DRAWING

Figure 1:
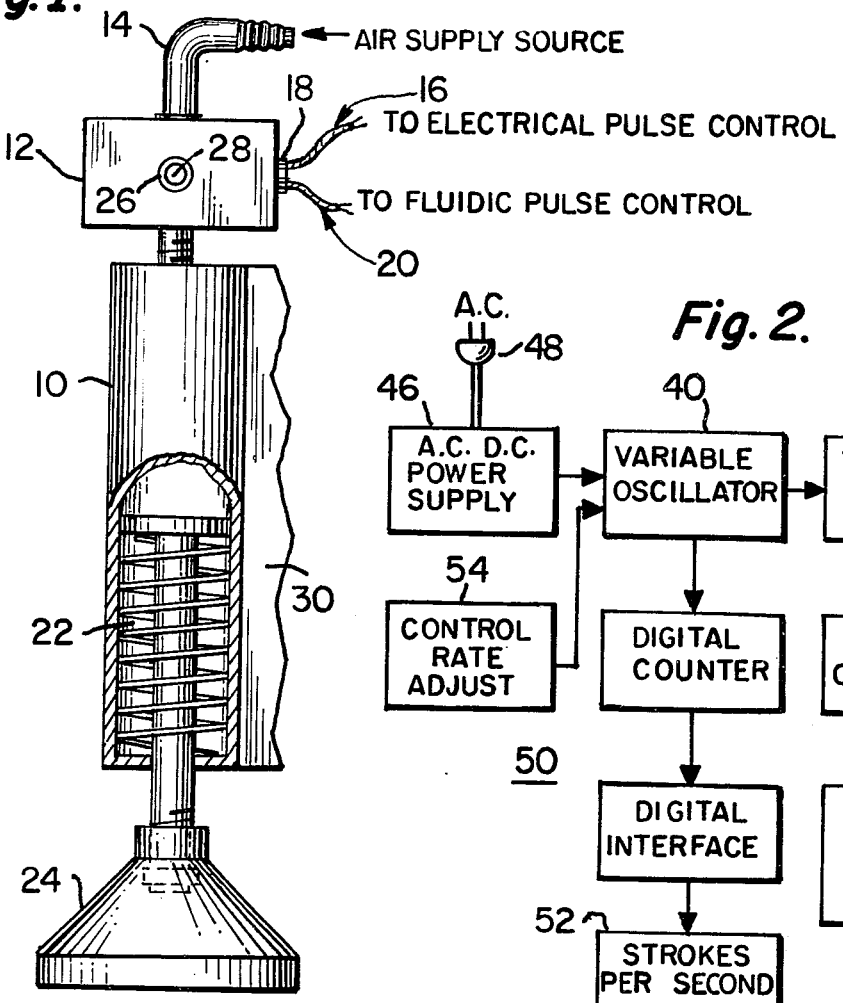
FIG. 1 is a diagram of a pneumatic percussor constructed in accordance with the invention.

Before considering the constructions of the drawing, it might be well to reflect upon the fact that the lungs can be visualized as a pair of mechanical cavities having a fundamental resonant frequency. With this in mind, it is feasible that the lungs can be induced into intermittent resonance at a fundamental frequency which will vary, depending on the physical size of the lungs and the degree of inhalation-exhalation. As this resonance would produce an intermittent oscillation of lung tissue, a flow of abnormal mucus — such as is present in cystic fibrosis cases — would result. By operating a percussor at a frequency which is substantially equal to the frequency of the force range (or to some harmonic of it), up to 1,200 strokes/minute, and by monitoring the audible responses of the lung cavity as a function of frequency, a feedback system could be devised to adjust the rate of percussor blows to produce optimum effectiveness for the individual under treatment. For this reason, pneumatic percussors built according to the invention, but intended for use in either a hospital or laboratory environment, might include the use of a display panel by which an operator could determine the best rate of reciprocation for the person tested, which can then be adjusted and set into the pneumatic percussor employed for home treatment of the individual.

Referring, now, more particularly, to FIG. 1, it will be understood that the reciprocating motion of the percussor is provided by an air cylinder 10, coupled via a three-way, high speed control valve 12 and connecting tubing 14 to a main source of air supply, such as a compressor of appropriate design. The control valve 12 may be of the type manufactured by Northeast Fluidics, of Bethany, Connecticut as its Model 2013, Fluidamp Electronic Interface Valve. With such a valve, electronic pulses are introduced by wiring or cabling 16 through a control port 18, to open the valve, and thereby permit the passage of compressed air from the main supply into the cylinder 10. In the case where the percussor is to be employed in an oxygen rich environment, fluidic bursts of air are introduced, as by tubing 20, to open the valve 12, in which case, the valve may be of the type manufactured by Northeast Fluidics at its Cincinatti, Ohio factory as its Model 2010, Fluidic Interface Control. Both such valves are mechanisms which provide a 5–10 millisecond switching time.

The air cylinder 10 is provided with a spring return plunger 22, capped at its arm end by a rubber suction cup 24. As will be readily apparent, air bursts from the main supply which pass the control valve 12 press against the bearing surface of the plunger, to actuate it downwards in the drawing, to be returned upwards to its initial condition under the action of the spring when the further supply of air is cut off. An exhaust port 26 is provided on the valve 12, to permit the release of air trapped in the cylinder 10 on the return stroke, and incorporates an appropriate exhaust silencer 28 so as to keep noise low. In actual construction of the invention, cylinder bore sizes between ⅞ inches and 1 ½ inches have been employed, with an overall cylinder length of some 4–6 inches. A hand grip 30, resembling what one might find on the handle bars of a bicycle, encompasses the cylinder 10 for ease of gripping.

Investigation has shown that for efficient operation, the output port of the three-way valve 12 should be in as close a proximity to the input port of the cylinder 10 as is mechanically possible. By making the valve 12 an integral part of the cylinder, therefore, highly favorable results can be achieved. In selecting the control valve 12, investigation has shown that its selection should be such as to permit the passage of 1 cubic foot of air in approximately one minute at a 35 pounds per square inch pressure.

As will be apparent, the blow-force of the percussor can be controlled either by increasing or decreasing the bore size of the cylinder 10, or by increasing or decreasing the pressure of the air supplied. With this percussor of the invention, a blow force at a controlled rate can be achieved, and because the entire weight of the device is of the order of 1 pound or less, the percussor can be accurately placed and easily held over prolonged usage. Noise levels as low as 75db have been achieved using an exhaust silencer of appropriate design, whereas the previously employed mechanical percussors have exhibited noise levels as high as 109db. With the unit lacking the forced air cooling system as is also present in the mechanical percussor, it will be seen that the possibility of having hair drawn into the cooling frame is substantially reduced. By utilizing the low weight and compact size of the percussor, as illustrated, the possibility of delivering a blow capable of bruising, or in extreme cases, fracturing, the small bones of a child's rib cage — or its clavical or sternum, for example — is substantially reduced. In one type of operation, a low cost diaphragm type compressor, of the type one might find in use as a paint sprayer, has been effectively utilized as an air supply when equiped with a 10 micron filter.

Figure 2:
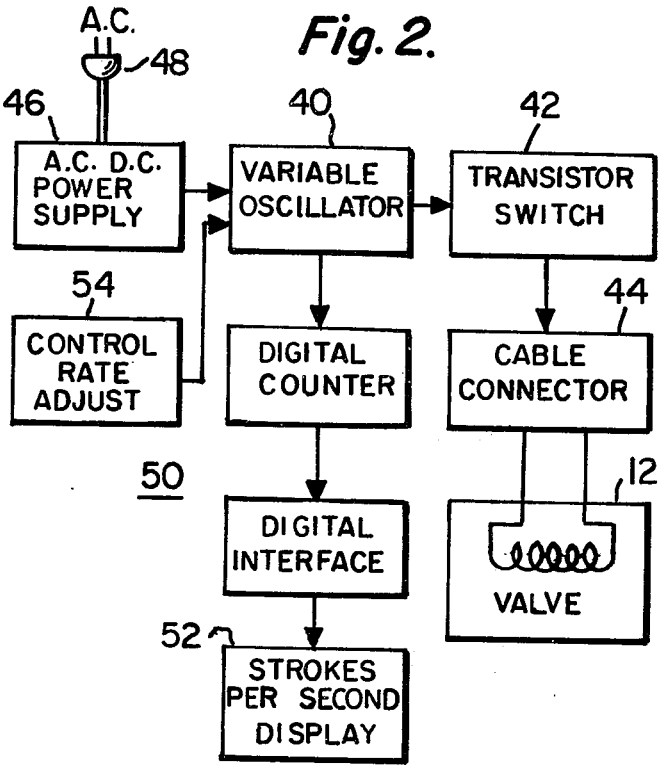
FIG. 2 is a block diagram of an electronic control circuit for use with the pneumatic percussor of FIG. 1.

As was previously mentioned, the three-way valve 12 can be controlled by an electronic pulse arrangement. Such a configuration is shown in FIG. 2 in which a variable oscillator 40 provides digital type pulses capable of operating a transistor switch 42 which, by means of an appropriate cable connector 44 can drive the control coil of the valve 12, such as the Fluidamp Model 2013. The variable oscillator 40 is provided its operating potential by means of an AC-DC power supply 46, which is, in turn connected, for example, to an AC outlet 48. For laboratory use, such as where the apparatus might be used in a hospital environment by an inhalation therapist to determine the rate at which the plunger blows should proceed for the individual. A digital counter or similar such solid state logic circuit 50 could be used to interface with a read out display 52 to indicate the number of plunger strokes per second. The frequency at which the oscillator 40 operates can be varied, as by an applicable adjustment means 54, to either speed up, or slow down the rate of valve openings and plunger reciprocations. Such adjustment means could be labelled in graduations so that, even without a display accessory, a user of the pneumatic percussor could merely set the frequency rate in accordance with that predetermined in the laboratory as most effective in inducing the lungs to an intermittent resonating condition as would assist in the breaking of mucus cloggage. Such adjustments can also be made during the theraputic treatment itself, as the clapping provided progressively loosens the mucus.

Figure 3:
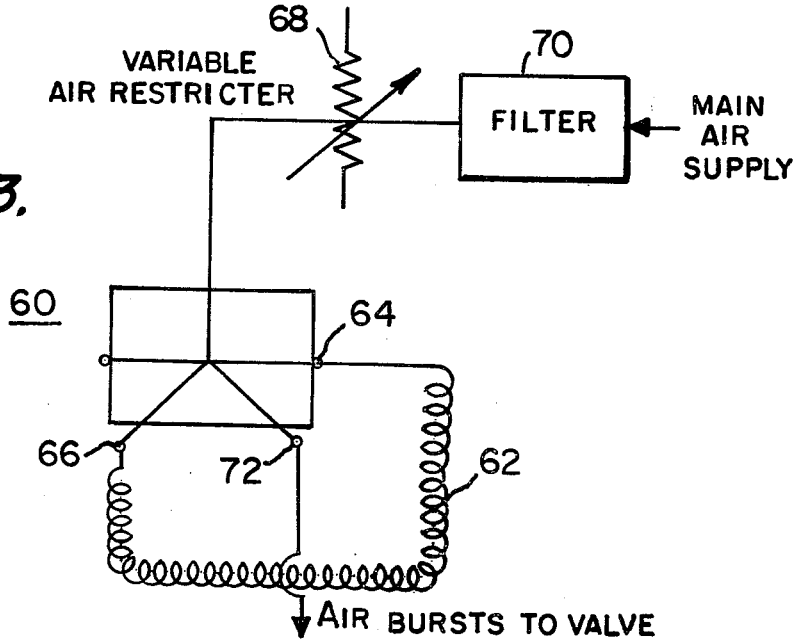
FIG. 3 is a block diagram of a fluidic control circuit for use with the percussor of FIG. 1.

In the second version of the pneumatic percussor, as shown in FIG. 3, a train of controlled low pressure air pulses are generated by using a fluidic flip-flop 60 as the oscillator and by placing a delay line 62 between one control port 64 and an appropriate output port 66 of the flip-flop so as to achieve a preset frequency of oscillation. In this case, a variable air restricter 68 couples the fluidic flip-flop 60 to a filter 70, and from there to the main air supply. The air restricter 68 provides a means of achieving variations in oscillator frequency, to operate the control diaphragm of the Model 2010 Fluidic Valve by means of air bursts from the second output port 72. A back pressure bleed cavity (not shown) is also located at the main valve 12 to permit the exhaust of this air, controlled so that once the above conditions have been satisfied, the three-way valve will track the generated air pulses at the established rate.

In an arrangement built according to this construction, the fluidic oscillator provided air pulses at 0.1 pounds per square inch pressure, to operate the Fluidic valve 12, which there received a main supply of air from one tap of the compressor and a control supply of air from the fluidic oscillator. Such use of a fluidic control eliminates the electrical switching of FIG. 2, and is therefore attractive for use in an explosive atmosphere. Here, too, an exhaust silencer is provided on the three-way control valve, to keep noise levels down when the spring return plunger reciprocates upwards to vent the trapped air, on its return stroke.

Besides the advantages of reduced mass and increased placement accuracy, the pneumatic percussor of the present invention offers the further advantage that the air which forces the plunger downwards also acts as a compressible cushion should the suction cup end of the plunger come to bear against a stationary object, such as a rib or a bone. Whereas the mechanical linkage of known percussors continues to push the plunger in a direction towards that rib or bone (and thereby possibly cause internal injury) the compressible cushion acts to prevent that from happening.

While there have been described what are considered to be preferred embodiments of the present invention, it will be readily apparent that other modifications may be made by those skilled in the art without departing from the teachings herein. In some instances, for example, it may be desirable to provide an air exhaust port on the cylinder 10, as well as on the control valve 12. For this reason, the scope of the invention should be interpreted in light of the claims appended hereto.

I claim:

1. A pneumatic percussor for stimulating lung cavities comprising:

an air chamber apertured at opposite ends thereof;

a plunger positioned within said chamber, having both a bearing surface and an arm extending through one of said apertures;

a valve having an input port adapted to be connected to an air supply, an output port intercoupled with the other one of said apertures of said chamber, and a control port;

suction means affixed adjacent the end of said plunger arm outside of said chamber; and means coupled to the control port of said valve to alternately gate the passage of air from a connected supply via said valve into said chamber so as to bear against said surface of said plunger and actuate said plunger in a direction outwardly of said chamber; and wherein said last-mentioned means includes an oscillator to gate the passage of air into said chamber in impulse manner, to actuate the plunger within at an impulse frequency to vibrate lung cavities towards a cough reflex.

2. The percussor of claim 1 wherein said plunger includes spring return means for actuating said plunger in a direction inwardly of said chamber when the passage of air from a connected supply is alternately blocked from reaching said chamber.

3. The percussor of claim 2 wherein said valve also includes an exhaust port to vent air stored in said chamber when said plunger is actuated inwardly therein.

4. The percussor of claim 3 wherein there is also included sound muting means to reduce noise levels as said stored air is vented from said chamber.

5. The percussor of claim 2 wherein said oscillator couples electrical pulses to the control port of said valve to alternately gate the passage of air from a connected supply via said valve, into said chamber.

6. The percussor of claim 5 wherein there is also included means for varying the frequency of said electrical pulses to adjust the rate at which said plunger is actuated in a direction outwardly of said chamber.

7. The percussor of claim 2 wherein said oscillator couples air bursts to the control port of said valve to alternately gate the passage of air from a connected supply via said valve, into said chamber.

8. The percussor of claim 7 wherein there is also included means for varying the frequency of occurrence of said air bursts to adjust the rate at which said plunger is actuated in a direction outwardly of said chamber.

9. The percussor of claim 2 wherein the input port of said valve is adapted to be connected to a source of compressed air.

* * * * *